US010793982B2

(12) United States Patent
Evrard et al.

(10) Patent No.: US 10,793,982 B2
(45) Date of Patent: Oct. 6, 2020

(54) METHOD OF NEEDLING A FIBER LAYER

(71) Applicant: ARIANEGROUP SAS, Paris (FR)

(72) Inventors: Hervé Evrard, Le Haillan (FR); Gareth Clarke, Saint-Medard-en-Jalles (FR); Edouard Borie, Eysines (FR); Thierry Constant, Ludon Medoc (FR)

(73) Assignee: ARIANEGROUP SAS, Paris (FR)

( * ) Notice: Subject to any disclaimer, the term of this patent is extended or adjusted under 35 U.S.C. 154(b) by 294 days.

(21) Appl. No.: 15/913,435

(22) Filed: Mar. 6, 2018

(65) Prior Publication Data

US 2018/0258566 A1 Sep. 13, 2018

(30) Foreign Application Priority Data

Mar. 7, 2017 (FR) ..... 17 51829

(51) Int. Cl.
*D04H 1/46* (2012.01)
*D04H 18/02* (2012.01)
(Continued)

(52) U.S. Cl.
CPC ..... *D04H 1/46* (2013.01); *D04H 1/498* (2013.01); *D04H 3/105* (2013.01); *D04H 5/02* (2013.01); *D04H 18/02* (2013.01)

(58) Field of Classification Search
CPC ..... D04H 1/46; D04H 18/02; D04H 1/498; D04H 1/4242; D04H 3/102; D04H 3/105; D04H 5/02; D04H 13/005
(Continued)

(56) References Cited

U.S. PATENT DOCUMENTS 460,805 A 10/1891 Whipple
3,431,611 A * 3/1969 Rentz ..... H05B 3/342 28/112
(Continued)

FOREIGN PATENT DOCUMENTS

EP 0 683 261 A2 11/1995
EP 2 816 147 A1 12/2014
WO WO 97/20092 A1 6/1997

OTHER PUBLICATIONS

Non-Final Office Action as issued in U.S. Appl. No. 15/913,370, dated Nov. 8, 2019.
(Continued)

*Primary Examiner* — Amy Vanatta
(74) *Attorney, Agent, or Firm* — Pillsbury Winthrop Shaw Pittman LLP

(57) ABSTRACT

A method of needling a fiber layer, includes first needling the fiber layer by a needling head, during which the fiber layer is caused to move in translation relative to the needling head, wherein needles of the needling head are distributed uniformly over a surface of the needling head; after the first needling, shifting the fiber layer relative to the needling head along a shift direction through a distance d equal to N·x·p, where N is an integer not less than 1, x is a coefficient greater than 0, and less than 1, and p designates the pitch of two consecutive needles of the needling head along the shift direction; and second needling the fiber layer, after the shifting, and during which the fiber layer is moved in translation relative to the needling head, the needles not penetrating, during the second needling, into the holes formed during the first needling.

11 Claims, 5 Drawing Sheets

(51) Int. Cl.
*D04H 3/105* (2012.01)
*D04H 1/498* (2012.01)
*D04H 5/02* (2012.01)

(58) Field of Classification Search
USPC ..... 28/107, 113, 114
See application file for complete search history.

(56) References Cited

U.S. PATENT DOCUMENTS 3,613,190 A * 10/1971 Crosby ..... C07D 493/08 28/109
3,845,529 A * 11/1974 Van Deusen ..... D04H 18/02 28/109
3,909,891 A 10/1975 Dilo
4,621,662 A 11/1986 Olry
4,790,052 A 12/1988 Olry
4,878,278 A 11/1989 Hsu
5,513,423 A 5/1996 Jakob
5,662,855 A 9/1997 Liew
6,009,605 A 1/2000 Olry
6,363,593 B1 4/2002 Duval
7,430,790 B1 * 10/2008 Bowles ..... D04H 18/02 28/107
2002/0133923 A1 * 9/2002 Duval ..... D04H 18/00 28/107
2009/0038129 A1 2/2009 Leger
2014/0373322 A1 12/2014 Gautier
2016/0108567 A1 4/2016 Simpson

OTHER PUBLICATIONS

Search Report as issued in French Patent Application No. 1751829, dated Oct. 4, 2017.

* cited by examiner

METHOD OF NEEDLING A FIBER LAYER

CROSS-REFERENCE TO RELATED APPLICATION

This application claims priority to French Patent Application No. 1751829, filed Mar. 7, 2017, the entire content of which is incorporated herein by reference in its entirety.

BACKGROUND OF THE INVENTION

The invention relates to a method of needling a fiber layer, and in particular to fabricating a fiber preform by using needling to bond a fiber layer to an underlying fiber structure.

Needling methods are known for fabricating fiber preforms made up of a plurality of fiber layers in a stack. In such methods, the fiber layers are stacked in succession on a needling table and they are needled by the action of a needling head. When a fiber layer is struck by the needling head, the layer is bonded with the underlying layer(s). Once the set of fiber layers has been stacked and needled, the resulting fiber preform can be densified by a matrix in order to form a part made of composite material.

The mechanical characteristics of the final part nevertheless depend on the needling actually performed within the fiber preform.

The present invention seeks to improve the mechanical properties of parts made of composite material including fiber reinforcement formed by needling.

OBJECT AND SUMMARY OF THE INVENTION

To this end, in a first aspect, the invention proposes a method of needling a fiber layer, the method comprising at least:

- a first needling step for needling the fiber layer by a needling head, during which the fiber layer is caused to move in translation relative to the needling head;
- a shift step, performed after the first needling step, during which the fiber layer is shifted relative to the needling head along a shift direction through a distance $\underline{d}$ equal to $N \cdot x \cdot p$, where N is an integer not less than 1, $\underline{x}$ is a coefficient greater than 0, and less than 1, and $\underline{p}$ designates the pitch of two consecutive needles of the needling head along the shift direction; and
- a second needling step for needling the fiber layer by the needling head, performed after the shift step, and during which the fiber layer is moved in translation relative to the needling head.

During the shift step, the needles of the needling head are shifted relative to the fiber layer. As a result, during the second needling step, the needles do not penetrate into the holes formed during the first needling step. As a result, a fiber layer is obtained in which the needling is more uniform. This makes it possible to obtain better introduction of the matrix material while the part is being formed, and thus to improve its mechanical properties. The fact that the needles do not penetrate into the same holes also makes it possible to reduce the risk of damaging the fiber layer during needling.

In an implementation, the movement in translation performed during the first needling step takes place along a movement axis, and the shift direction is not perpendicular to the movement axis. In particular, the shift direction is parallel to the movement axis.

In a variant, the movement in translation during the first needling step is performed along a movement axis, and the shift direction is perpendicular to the movement axis.

In an implementation, the movement in translation during the first needling step is performed in a first direction of advance, and the movement in translation during the second needling step is performed in a second direction of advance, opposite to the first direction of advance.

In an implementation, the fiber layer is moved in translation along a movement axis during each of the first and second needling steps, and the position of the needling head along the movement axis is stationary during each of the first and second needling steps.

In an implementation, during each of the first and second needling steps, stages of movement in translation along the movement axis alternate with stages of stopping movement along that axis, with the fiber layer being needled by the needling head during the stages of stopping.

Performing needling during the stages of stopping serves advantageously to reduce shear in the fiber layer during needling and to further improve the mechanical properties of the part.

In an implementation, the needling head is held stationary and the fiber layer is moved through the distance $\underline{d}$ along the shift direction during the shift step.

In an implementation, the coefficient $\underline{x}$ lies in the range 0.1 to 0.9, e.g. in the range 0.2 to 0.8, e.g. in the range 0.3 to 0.7, or indeed in the range 0.4 to 0.6.

The present invention also provides a method of fabricating a needled multilayer fiber preform including at least one fiber layer bonded to an underlying fiber structure by needling by performing a method as described above.

The present invention also provides a method of fabricating a composite material part comprising at least the following steps:

- fabricating a fiber preform that is to form the fiber reinforcement of the part that is to be obtained by performing the method as described above; and
- forming a matrix in the pores of the fiber preform in order to obtain the composite material part.

BRIEF DESCRIPTION OF THE DRAWINGS

Other characteristics and advantages of the invention appear from the following description of particular implementations of the invention given as non-limiting examples, and with reference to the accompanying drawings, in which.

DETAILED DESCRIPTION OF IMPLEMENTATIONS

Figure 1:
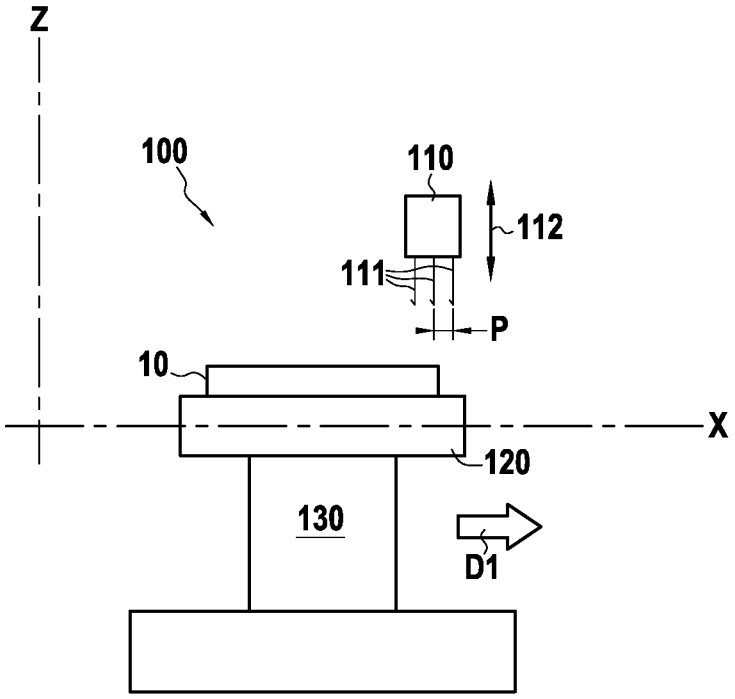
FIGS. 1 to 8 are diagrammatic and fragmentary views showing the conduct of a first implementation of a needling method of the invention.

The conduct of a first implementation of a needling method of the invention is described initially with reference to FIGS. 1 to 8.

In general manner, a needling machine 100 is used that comprises a needling head 110 having needles 111 and a support carrying a fiber layer 10 for needling, which support is constituted in this example by a table 120.

In order to perform the needling, the needling head 110 may be moved vertically above the table 120, i.e. along the direction Z shown in the figures. The needling head 110 moves both downwards and upwards along the vertical direction Z, as represented by double-headed arrow 112. The needling head 110 is thus driven with reciprocating vertical motion (i.e. back-and-forth motion) relative to the table 120. The needling head 110 carries a determined number of needles 111 that are provided with barbs, hooks, or forks for taking hold of fibers in the fiber layer 10 and transferring them through said layer. In known manner, these needles 111 are arranged in a plurality of rows of needles, these rows being visible in FIG. 3. The needles 111 are uniformly distributed over a surface of the needling head 110. Two consecutive rows of needles 111 in the direction X shown in the figures are spaced apart by a distance marked p.

Figure 3:
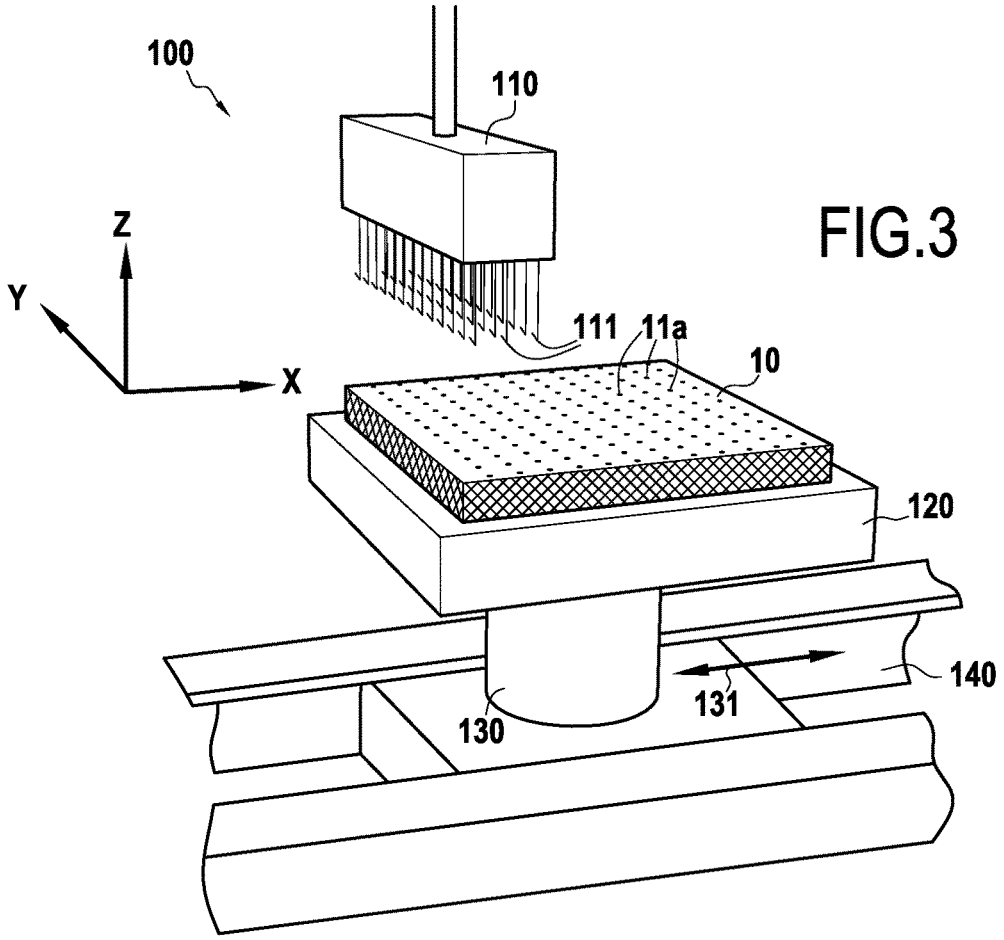

The table 120 extends in horizontal directions X and Y perpendicular to the direction Z (see FIG. 3). In the example shown, the table 120 is movable in translation along the movement axis constituted by the direction X. In this example, the table 120 is mounted on a post 130 that is movable in translation in a rail 140 that extends along the direction X. The table 120 can thus be moved in rectilinear translation along the movement axis X under the needling head 110.

With reference to FIGS. 1 to 4, the description begins with performing the first needling step in the first implementation of the method of the invention.

FIG. 1 shows the needling machine 100 at the beginning of the first needling step. During the first needling step, the fiber layer 10 is moved in translation along the movement axis X in a first direction of advance D1. The fiber layer 10 may be a layer of woven fabric or a uni- or multi-directional sheet. The fibers of the fiber layer 10 may be carbon fibers or ceramic fibers. In the presently-considered implementation, the position of the needling head 110 along the directions X and Y remains unchanged during the first needling step. In this implementation, the needling head 110 performs only transverse reciprocating motion relative to the fiber layer 10 during the first needling step. In this implementation, the needling head 110 moves only with vertical back-and-forth motion along the direction Z during the first needling step. In a variant, it would nevertheless be possible to keep the fiber layer 10 stationary and move the needling head 110 in translation during the first needling step.

Figure 2:
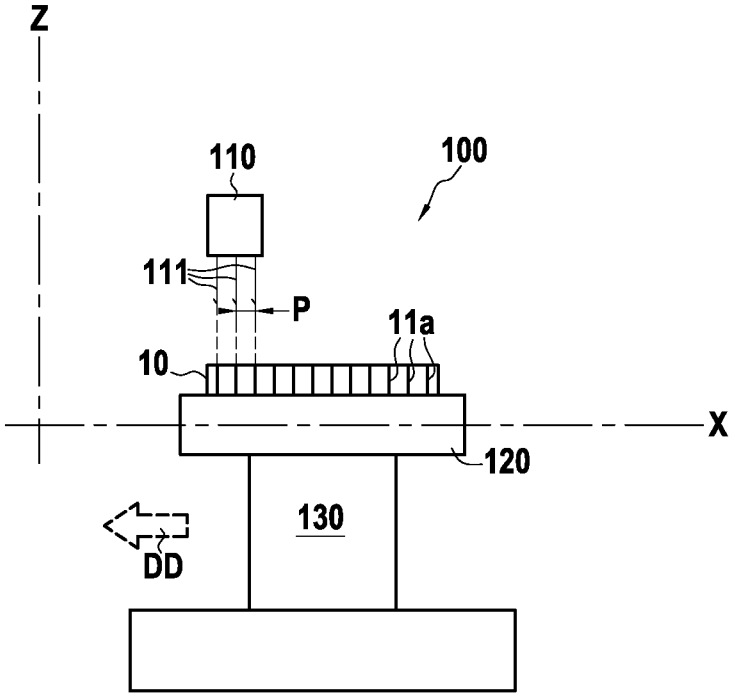

FIG. 2 shows the arrangement of the various elements obtained at the end of the first needling step. During the first needling step, the needles 111 penetrate into the fiber layer 10 and form a first set of holes 11*a* therein. Two holes 11*a* of the first set following one another along the movement axis X are spaced apart by the pitch p, which corresponds to the distance between two consecutive needles 111 along the axis X. The holes 11*a* correspond to the locations where the needles 111 have entered into the fiber layer 10 during the first needling step. In order to enable the needles 111 to pass through the fiber layer 10 without being damaged, it is possible in known manner to interpose a layer of felt (not shown) between the table 120 and the fiber layer 10.

The situation shown has only one fiber layer that is needled by performing the method of the invention. Naturally, in a variant, it would be possible to position a fiber layer on an underlying fiber structure and then to perform a needling method of the invention in order to bond the fiber layer 10 to the fiber structure. Under such circumstances, the needling serves to cause the fibers of the fiber layer 10 to penetrate into the underlying fiber structure in order to provide bonding between those two elements.

Figure 4:
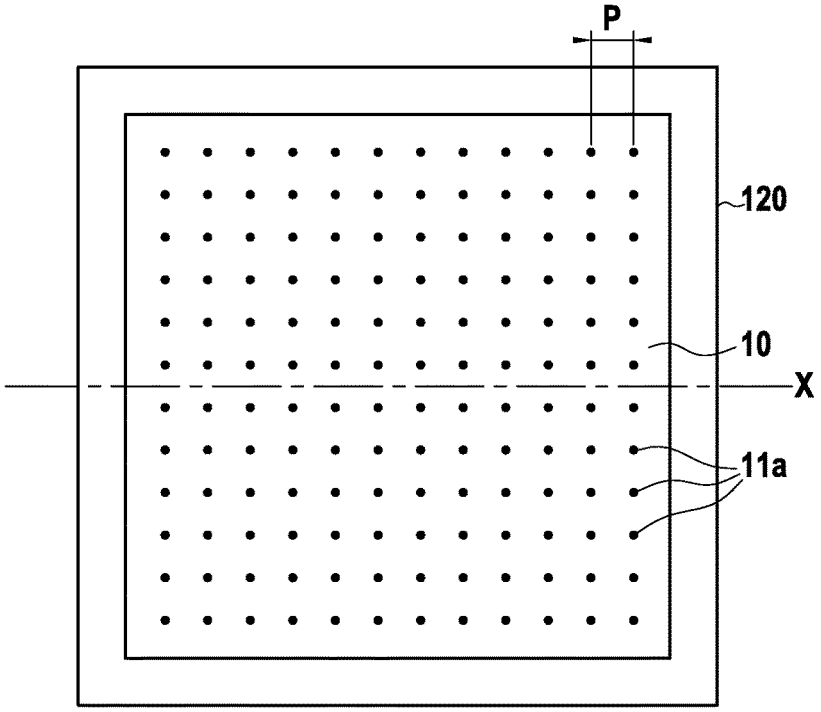

FIG. 3 is a perspective view of the fiber layer 10 obtained after the first needling step, showing the first set of holes 11*a*. FIG. 4 is a plan view of the first fiber layer 10 on table 120 immediately after performing the first needling step. After this first needling step, the fiber layer 10 is in a first position relative to the needling head 110 (position shown in FIGS. 2 and 3). In this first position, the needles 111 of the needling head 110 are situated facing holes 11*a* formed in the fiber layer.

Thereafter, after the first needling step, a shift step is performed for shifting the fiber layer 10 relative to the needling head 110. The purpose of this shift step is to ensure that the needles 111 do not pass once more through the holes 11*a* during the second needling step.

Figure 5:
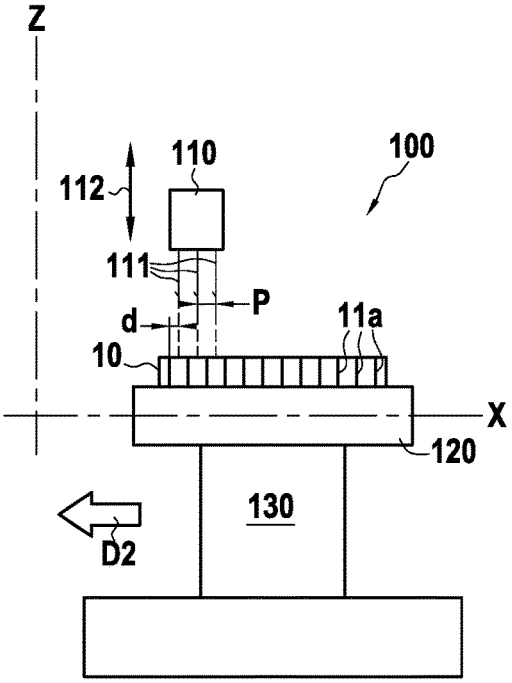
Figure 6:
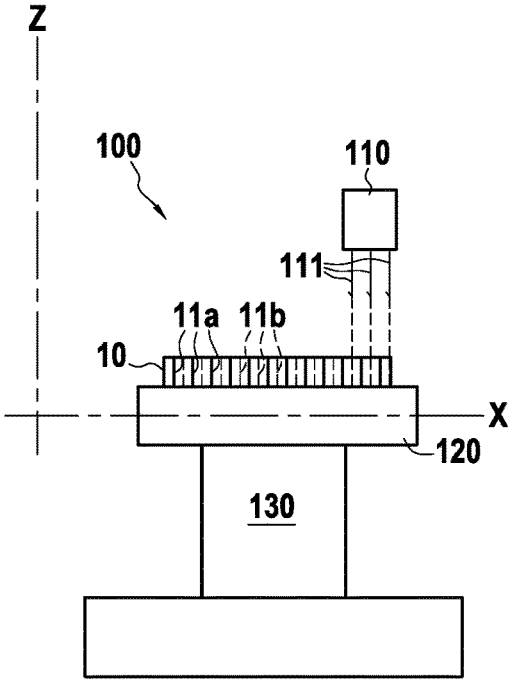
Figure 7:
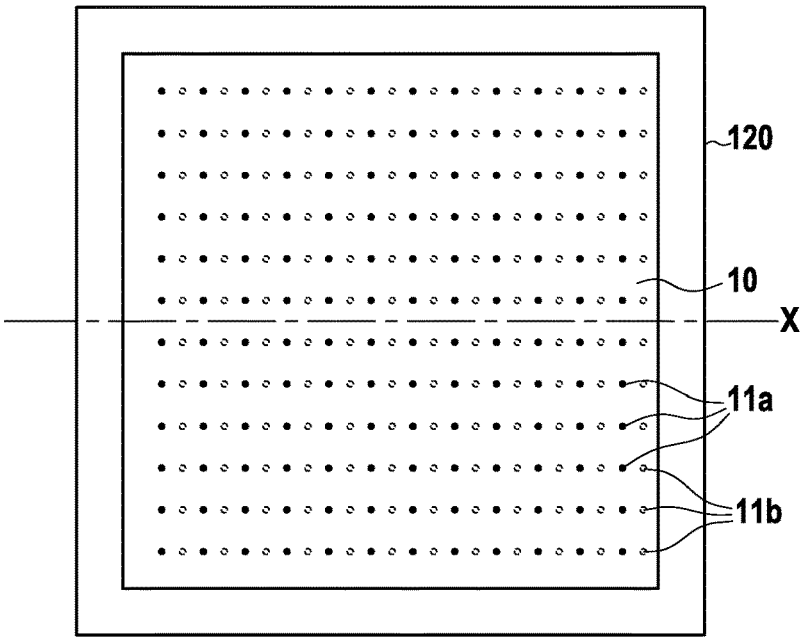

FIG. 2 in particular shows the fact that the fiber layer 10 is moved relative to the needling head 110 along a shift direction referenced DD. In the example shown, the needling head 110 is stationary during the shift step and it is the fiber layer 10 that is moved through a predetermined distance d. Nevertheless, it would not go beyond the ambit of the invention for the fiber layer 10 to be stationary and for the needling head to move during the shift step. During the shift step, the fiber layer 10 or the needling head is caused to move in translation along the shift direction DD. FIG. 5 shows the relative arrangement that is obtained after the shift step has been performed. As shown in FIG. 5, the needling head 110 is in a second position relative to the fiber layer 10 after the shift step. In this second position, the needles 111 face zones 12 of the fiber layer 10 that are situated between the holes 11*a* of the first set. Thus, after the shift step, the needles 111 of the needling head 110 are positioned between the holes 11*a* of the first set so as to ensure that these needles 111 do not penetrate into the holes 11*a* during the second needling step.

In the example shown, the fiber layer 10 is shifted in the shift direction DD, which in this example is parallel to the movement axis X. In the example shown, the fiber layer is shifted through a distance d that is substantially equal to 0.5p, where p corresponds to the distance between two consecutive needles 111 along the shift direction DD (or the axis X). In the situation shown diagrammatically in FIGS. 2 and 5, the formula given above for the distance d thus has values N=1 and x=0.5. In a variant, N could have some other value such as 2, 3, or 4 . . . , and x could have a value other than 0.5, so long as its value is greater than 0 and less than 1. The product N·x may not be an integer.

Thereafter, the second needling step is performed with the fiber layer 10 in the second position at the beginning of the second needling step. During the second needling step, the fiber layer 10 is moved in translation along the movement axis X in a second direction of advance D2. In the presently-considered example, the position of the needling head 110 along the directions X and Y remains unchanged during the second needling step. In this example, the needling head 110 is driven solely with reciprocating motion transversely relative to the fiber layer 10 during the second needling step. In this example, the needling head 110 is driven solely with go-and-return motion vertically along the direction Z during the second needling step. Nevertheless, in a variant, it would be possible to keep the fiber layer 10 stationary and to move the needling head 110 in translation during the second needling step.

In the example shown, it should be observed that the second direction of advance D2 is opposite to the first direction of advance D1. In this example, the fiber layer 10 is moved in translation along the same movement axis X as during the first needling step, but in an opposite direction of advance D2. The example shown thus relates to a "go-and-return" needling method during which the fiber layer 10 is subjected to the first needling step in the go direction and is subjected to the second needling step in the return direction.

Other variants are possible for moving the fiber layer during the second needling step. By way of example, at the end of the first needling step, it would be possible in the FIG. 2 configuration to perform the shift step by shifting the needling head 110 towards the opposite end of the fiber layer 10 and then perform the second needling step while moving the fiber layer in the first direction of advance D1. Under such circumstances, the fiber layer 10 would always move in the same direction (i.e. the direction of advance D1) during both the first and the second needling steps. Nevertheless, it is advantageous to perform needling in two "go-and-return" steps as shown so as to reduce the length of the installation needed for needling the fiber layer.

During the second needling step, the needles 111 penetrate into the fiber layer 10 and form a second set of holes 11*b* therein. The speed of advance of the fiber layer 10, or of the needling head if it is the needling head that moves, may be identical during the first and second needling steps. The frequency with which the needles 111 impact against the fiber layer 10 may be identical during the first and second needling steps. Two holes 11*b* of the second set following each other along the movement axis X are spaced apart at the pitch p.

After the second needling step and on moving along the movement axis X, the fiber layer presents holes 11*a* of the first set alternating with holes 11*b* of the second set. During the second needling step, because the shift step has been performed, the needles 111 carried by the needling head 110 do not impact into the holes 11*a* of the first set. This produces the fiber layer shown in FIGS. 6 and 7, comprising the first set of holes 11*a* and the second set of holes 11*b* that are offset from the first set. The holes 11*a* and 11*b* of the first and second sets are formed in the same fiber layer 10. Performing the shift step between the first and second needling steps thus makes it possible to make the distribution of needling points more uniform without damaging the fiber layer.

During each of the first and second needling steps, stages of moving in translation along the movement axis may alternate with the stages of stopping along that axis, with the fiber layer being needled by the needling head during the stages of stopping. Under such circumstances, the movement in translation performed during the first and second needling steps is performed incrementally. The needling is advantageously performed solely during stages of stopping. During each of the first and second needling steps, it is possible to alternate between stages of moving the fiber layer in translation along the movement axis and stages of stopping the fiber layer, with needling being performed during these stages of stopping. During each of the first and second needling steps, it is also possible to alternate between stages of moving the needling head in translation along the movement axis and stages of stopping the needling head in its movement along the movement axis, with needling being performed during these stages of stopping. The invention also relates to the variant in which movement is performed continuously during the needling step. The needles of the needling head may also be of elongate shape so as to give them flexibility for limiting shear in the fiber layer.

The above-described example relates to needling a single fiber layer. It would not go beyond the ambit of the invention for the fiber layer that is needled by the method of the invention to be positioned on an underlying fiber structure. The fiber structure could comprise one or more fiber layers, e.g. connected together by needling. When the fiber layer is positioned on a fiber structure, the needling that is performed enables the fibers of the fiber layer 10 to penetrate into the underlying fiber structure, thereby bonding together the fiber layer and that structure. This produces a fiber preform that is to form the fiber reinforcement of a composite material part that is to be obtained.

Once a fiber layer has been needled by the method of the invention, a second fiber layer may be positioned thereon. Thereafter, the second fiber layer can be needled by the method of the invention in order to be connected to the underlying first fiber layer. The table 120 may be moved down a step in order to control the depth to which the needles penetrate into the first and second fiber layers. The method may be repeated by stacking at least one third fiber layer on the first and second fiber layers.

Figure 8:
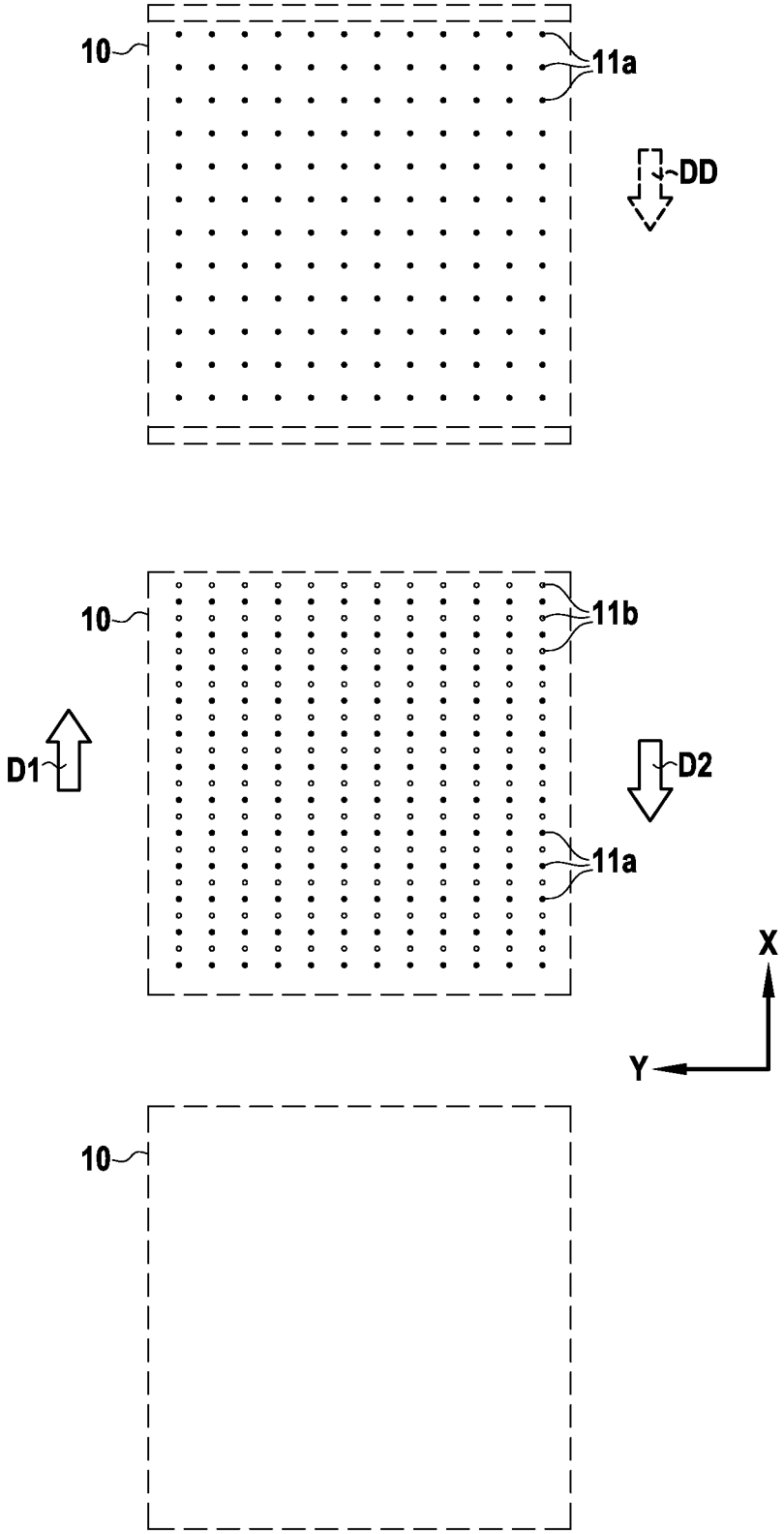

The above description with reference to FIGS. 1 to 7 relates to an example of the needling method in which the shift direction DD is parallel to the movement axis X. This situation is summarized in FIG. 8 in which the bottom portion shows the fiber layer 10 before performing the first needling step (no hole has yet been formed). The top portion of FIG. 8 shows the fiber layer 10 after performing the first needling step, both before and after the step of shifting along the direction DD (the holes 11*a* shown in the top portion are in positions that correspond to their positions before shifting). The middle portion of FIG. 8 shows the fiber layer after the second needling step in which holes 11*b* of the second set are present alternating with the holes 11*a* of the first set. Nevertheless, the invention is not limited to shifting along a shift direction DD that is parallel to the movement axis X, as is described below.

Figure 10:
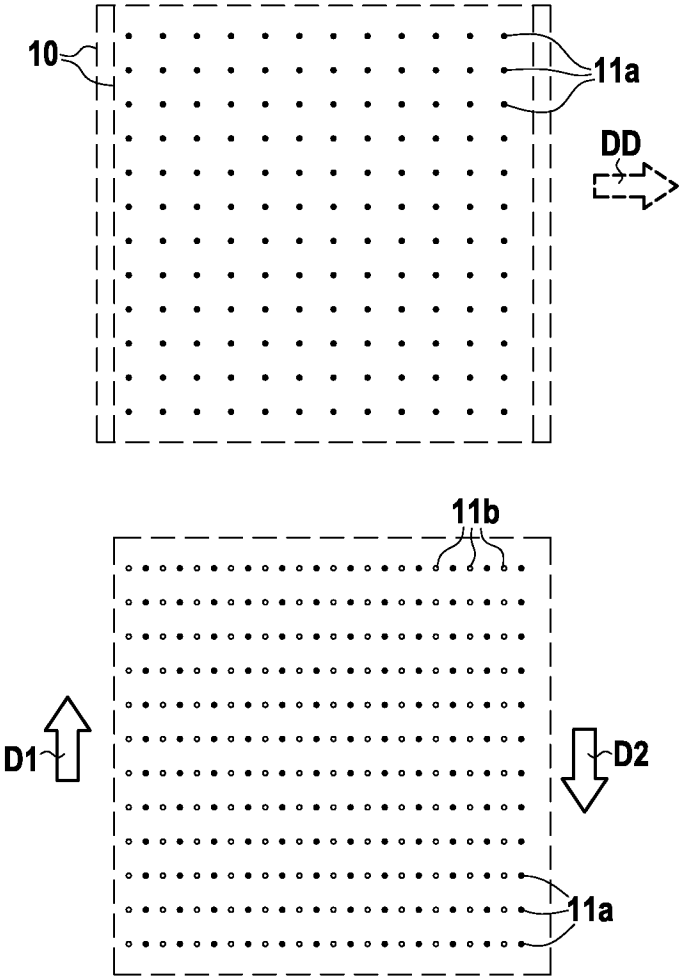
FIG. 10 is a diagrammatic and fragmentary view from above showing the conduct of a third implementation of a needling method of the invention.
Figure 9:
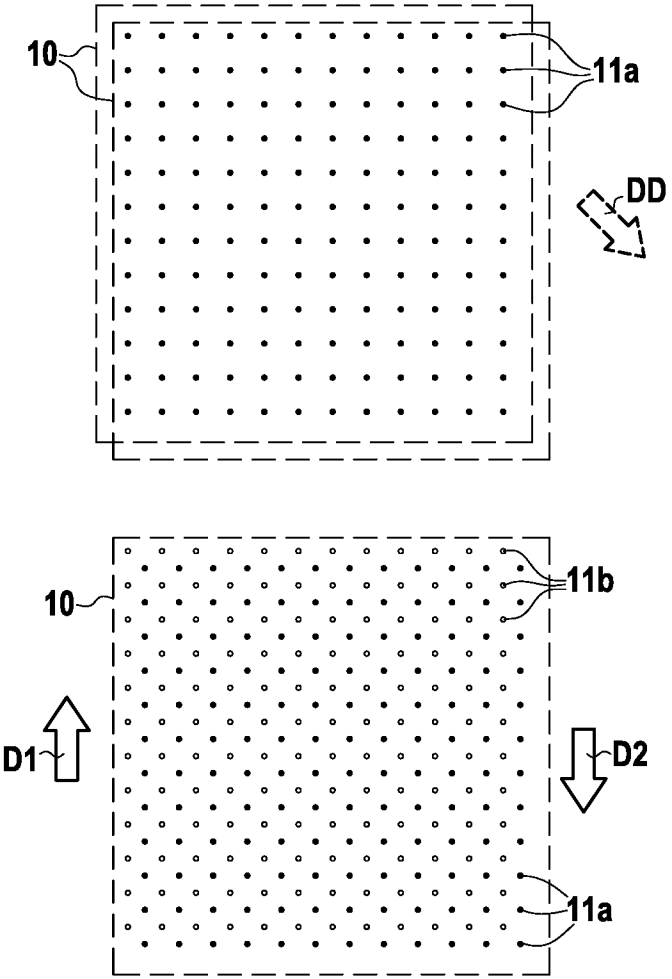
FIG. 9 is a diagrammatic and fragmentary view from above showing the conduct of a second implementation of a needling method of the invention.

Specifically, FIG. 9 shows the situation in which a shift is performed in a shift direction DD that extends transversely but not perpendicularly relative to the movement axis X. In the situation showing in FIG. 9, the shift direction DD forms an angle substantially equal to 45° with the axis X. Similarly, FIG. 10 shows the situation in which a shift is performed in a shift direction DD perpendicular to the movement axis X. In both of these situations, the fiber layer 10 is moved in translation in a second direction of advance D2 opposite to the first direction of advance D1 during the second needling step.

It is possible to form a fiber preform for a part made of composite material by performing the needling method as described above. Once the preform has been obtained, a matrix can be formed in the pores of that preform in a manner that is itself known. The matrix densifying the fiber preform may be organic, ceramic, or made of carbon. It is possible to envisage various known methods for forming a matrix, such as for example injecting a liquid polymer followed by applying heat treatment thereto in order to cross-link it, and possibly also to pyrolize it, thereby forming the matrix. It is also possible to use a method of densification by a gaseous technique in which the matrix is formed by infiltration using a precursor in the gaseous state.

The resulting part made of composite material may be a valve body or a valve needle.

The term "lying in the range . . . to . . . " should be understood as including the bounds.

The invention claimed is:

1. A method of needling a fiber layer, the method comprising:

a first needling step wherein the fiber layer is needled by a needling head, during which the fiber layer is caused to move in translation relative to the needling head, wherein needles of the needling head are distributed uniformly over a surface of the needling head;

a shift step, performed after the first needling step, during which the fiber layer is shifted relative to the needling head along a shift direction through a distance d equal to N*x*p, where N is an integer not less than 1, x is a coefficient greater than 0, and less than 1, and p designates the pitch of two consecutive needles of the needling head along the shift direction; and a second needling step wherein the fiber layer is needled by the needling head at least in a zone of the fiber layer needled during the first needling step, the second needling step being performed after the shift step, and during which the fiber layer is moved in translation relative to the needling head, the needles not penetrating, during the second needling step, into the holes formed during the first needling step in the zone of the fiber layer needled during the first needling step.

2. A method according to claim 1, wherein the movement in translation performed during the first needling step takes place along a movement axis, and wherein the shift direction is not perpendicular to the movement axis.

3. A method according to claim 2, wherein the shift direction is parallel to the movement axis.

4. A method according to claim 1, wherein the movement in translation during the first needling step is performed along a movement axis, and wherein the shift direction is perpendicular to the movement axis.

5. A method according to claim 1, wherein the movement in translation during the first needling step is performed in a first direction of advance, and wherein the movement in translation during the second needling step is performed in a second direction of advance, opposite to the first direction of advance.

6. A method according to claim 1, wherein the fiber layer is moved in translation along a movement axis during each of the first and second needling steps, and wherein the position of the needling head along the movement axis is stationary during each of the first and second needling steps.

7. A method according to claim 1, wherein, during each of the first and second needling steps, stages of movement in translation along the movement axis alternate with stages of stopping movement along that axis, with the fiber layer being needled by the needling head during the stages of stopping.

8. A method according to claim 1, wherein the needling head is held stationary and the fiber layer is moved through the distance d along the shift direction during the shift step.

9. A method according to claim 1, wherein the coefficient x lies in the range 0.1 to 0.9.

10. A method of fabricating a needled multilayer fiber preform including bonding the fiber layer to an underlying fiber structure by needling the fiber layer using a method according to claim 1.

11. A method of fabricating a composite material part comprising:

fabricating a fiber preform that is to form a fiber reinforcement of the part, the preform being obtained by performing the method according to claim 10; and forming a matrix in pores of the fiber preform in order to obtain the composite material part.

* * * * *